US007055203B1

(12) United States Patent
Franzino

(10) Patent No.: US 7,055,203 B1
(45) Date of Patent: Jun. 6, 2006

(54) TUBE CLEANING MACHINE

(75) Inventor: Joseph J Franzino, Redding, CT (US)

(73) Assignee: Goodway Technologies Corporation, Stamford, CT (US)

( * ) Notice: Subject to any disclaimer, the term of this patent is extended or adjusted under 35 U.S.C. 154(b) by 332 days.

(21) Appl. No.: 10/295,636

(22) Filed: Nov. 15, 2002

Related U.S. Application Data

(60) Provisional application No. 60/336,034, filed on Nov. 15, 2001, provisional application No. 60/336,035, filed on Nov. 15, 2001.

(51) Int. Cl.
*B08B 9/06* (2006.01)

(52) U.S. Cl. ..... 15/104.095; 15/104.09; 15/104.05; 15/104.12; 134/166 R

(58) Field of Classification Search ..... 15/104.05, 15/104.09, 104.095, 104.096, 104.12, 104.31, 15/104.33; 134/100.1, 166 C, 167 C, 168 C, 134/169 C, 166 R, 167 R
See application file for complete search history.

(56) References Cited

U.S. PATENT DOCUMENTS

| | | | | |
|---|---|---|---|---|
| 2,158,577 | A * | 5/1939 | Haley | 15/104.095 |
| 4,700,422 | A * | 10/1987 | Russell | 15/104.33 |
| 5,235,718 | A * | 8/1993 | Grimsley et al. | 15/104.095 |
| 5,426,807 | A * | 6/1995 | Grimsley et al. | 15/104.33 |
| 5,813,089 | A * | 9/1998 | Nolan et al. | 15/383 |
| 6,047,431 | A * | 4/2000 | Canonica | 15/104.095 |

* cited by examiner

*Primary Examiner*—Richard Crispino
*Assistant Examiner*—Shay L. Balsis
(74) *Attorney, Agent, or Firm*—Patrick J. Walsh

(57) ABSTRACT

A tube cleaning machine for industrial smooth bore tubes and enhanced tubes in which the machine includes a rotary brush with means for selecting brush rotary speed for optimum cleaning of the smooth bore and enhanced tubes, and in which the machine includes a water side and a chemical side for supplying a cleaning medium to tubes being cleaned.

6 Claims, 2 Drawing Sheets

TUBE CLEANING MACHINE

RELATED APPLICATION

This application is directed to the inventions described in U.S. Provisional Application Ser. Nos. 60/336,034 and 60/336,035, both filed Nov. 15, 2001, and claims priority of said applications.

BACKGROUND OF THE INVENTION

The present invention is directed to tube cleaning machines for cleaning the tubes and pipes of power plant equipment such as boilers, condensers, heat exchangers and so forth. In tube cleaning such equipment, an operator uses commercially available equipment such as described in U.S. Pat. Nos. 5,235,718 and 5,426,807. Such equipment comprises a rotating brush and water flush that an operator inserts into each tube to be cleaned. The equipment rotates the brush by means of a drive shaft and propels the brush and sheath encased drive shaft the full length of each tube for cleaning, provides the water flush, and withdraws the brush after the tube is so cleaned.

Tube cleaning brushes have a twisted wire spine securing bristles in a spiral or helix pattern such that a rotating brush has a natural feed rate into and through a tube by rotation in one direction, and back out of the tube by rotation in the opposite direction.

Power plant equipment may be fitted with tubes having a smooth bore or with tubes having a rifled bore to enhance heat transfer which are referred to herein as enhanced tubes. In the case of enhanced tubes, the rifling helix defines the natural feed rate of a rotating brush through the tube. With enhanced tubes, it is important to minimize slip between a rotating cleaning brush and the grooves in the tube. Excessive slip will not allow the brush bristles into the grooves thus leaving them fouled. Excessive slip occurs when rotational speed of the brush exceeds the natural feed rate of the rifling helix in the tube.

A related condition can also occur which is the pushing the brush linearly through an enhanced tube over the grooves where the brush is not rotating quickly enough.

The present invention provides a tube cleaning machine enabling an operator regulate brush speed for proper cleaning of both smooth bore and enhanced tube equipment.

SUMMARY OF THE INVENTION

In accordance with the present invention the condition of excessive slip is corrected by increasing the linear speed of the brush through the tube or by adjusting speed of brush rotation.

In a preferred embodiment, a tube cleaning machine of the present invention comprises a drive motor with motor controller for driving both a water pump and for the brush drive shaft, a chemical injection solenoid and injector, a water valve solenoid and a water high pressure line for supplying cleaning water for cleaning tubes. A control system including in preferred form a forward air switch acts to open the water and chemical solenoids on the forward travel of a rotating brush through a tube being cleaned. In a reverse motion of the brush from a tube the motor controller activates only the water solenoid for continued water supply to a tube. When the reverse control is deactivated, the motor is stopped and the water solenoid is closed.

In accordance with the invention, the operating motor is provided with a potentiometer for controlling motor speed and thereby brush speed as well as pressure and flow of water (and chemical if desired) through a tube. In this way the operator selects the proper brush speed for tube cleaning especially for enhanced tubes to minimize undesirable slip of a cleaning brush part the grooves of an enhanced tube.

Additional advantages of the invention will become apparent to those skilled in the art upon reference to the detailed description taken in conjunction with the accompanying drawing.

DETAILED DESCRIPTION OF THE PREFERRED EMBODIMENTS

Figure 1:
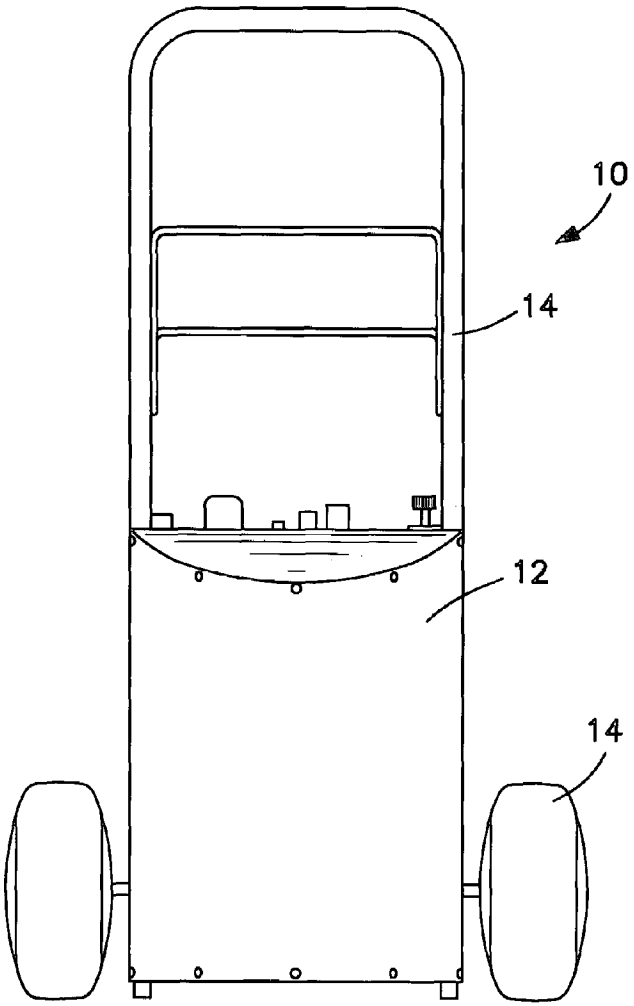
FIG. 1 is a front elevation view of a tube cleaning apparatus according to the invention including power console.
Figure 2:
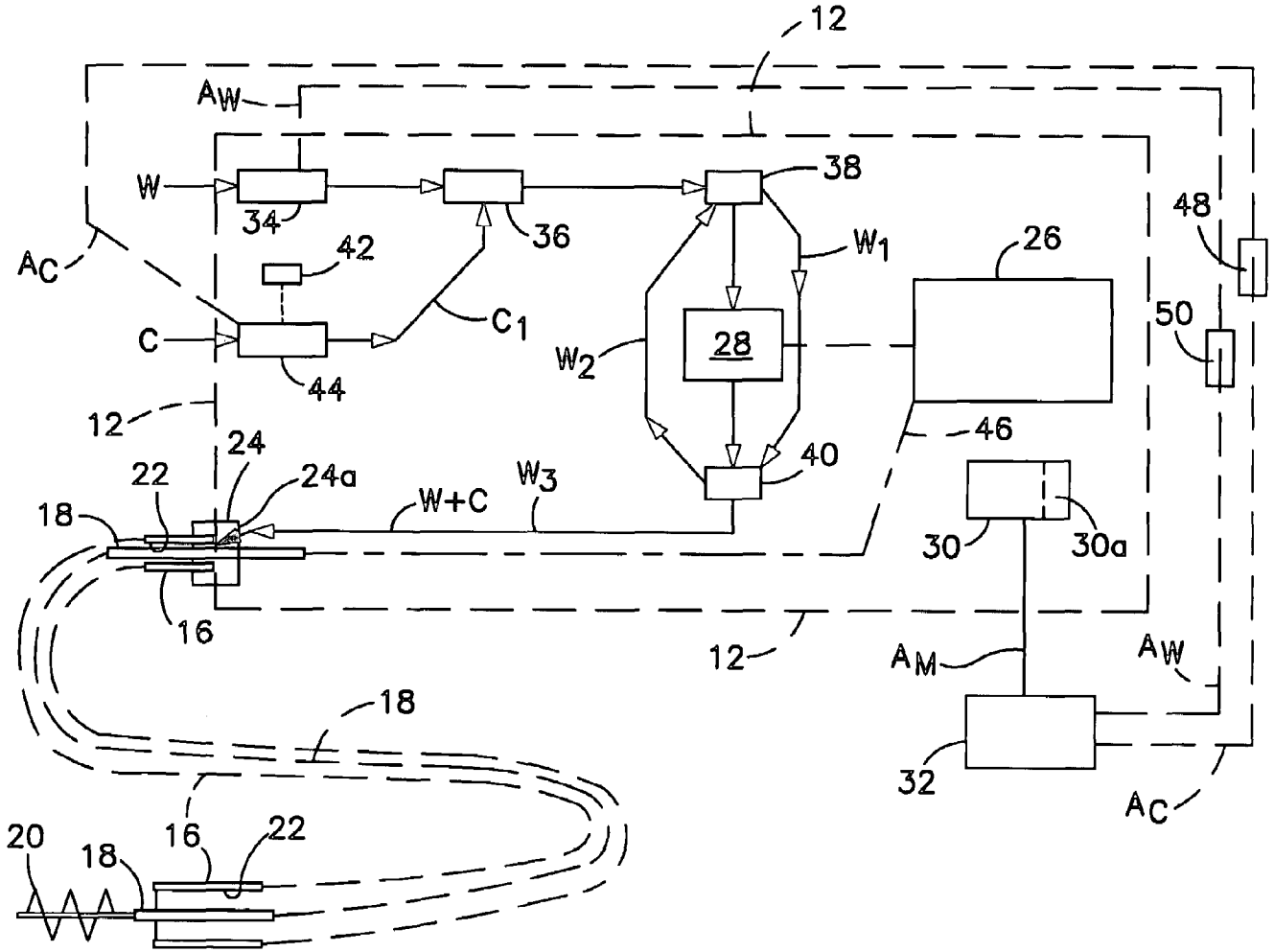
FIG. 2 is a schematic view of the operating components of a tube cleaning machine according to the invention.

Referring to FIGS. 1 and 2 of the drawing, the tube cleaning machine 10 includes a power console 12 mounted on a hand truck 14 and an elongate sheath 16 (FIG. 2) which encases a flexible drive shaft 18 for rotating a tube cleaning brush 20 mounted at the far end of the flexible shaft. The sheath defines an enclosed interior channel 22 for passage of water W and cleaning chemicals C from the power console to the brush end of the sheath. An end cap 24 mounts sheath and flexible drive shaft to the power console and has openings 24*a* for passage of water and chemicals into the sheath interior channel. The operating components of the tube cleaning machine shown in schematic form in FIG. 2 are mounted within the power console.

Referring to FIG. 2, the operating components of the tube cleaning machine include a electric drive motor 26 for rotating the flexible rotary shaft 18 and for driving a tube cleaning water pump 28. The motor has a motor controller 30 with an air switch actuation pedal 32 for forward and reverse motor rotation.

The water side of the tube cleaning machine comprises a water line W having a solenoid valve 34, a chemical injector 36, a bypass valve 38 for directing water either to the water pump 28 or to a pump bypass line $W_1$, a safety valve 40, a safety valve return line $W_2$, and a line connection $W_3$ to the end cap 24.

The chemical side of the tube cleaning machine comprises a toggle switch 42, a solenoid valve 44 and a chemical line $C_1$ to the chemical injector 36.

The air switch actuation pedal 32 controls operation of the water solenoid valve and the chemical solenoid valve respectively through air lines $A_C$ and $A_W$ and air switches 48 and 50 respectively. The air switches are air activated electric contact switches that receive air pulses from the pedal 32 and activate the chemical and water solenoids as desired.

As noted above, the tube cleaning brush is mounted at the far end of flexible rotary drive shaft 18 with the drive shaft being encased in the stationary protective sheath 16 defining an interior passage 22 from the end cap to the brush far end. The drive shaft is rotated by means of the electric drive motor. The sheath, brush, and brush drive shaft assembly are driven linearly through a tube being cleaned at a natural feed rate induced by the helical arrangement of cleaning brush bristles as is known.

A supply of flush water W and cleaning chemical C are introduced into the interior passage 22 of the sheath by means of the water pump driven by the drive motor and chemical injector 36 preferably in the form of an venturi tube. Flow of water and chemical through the water line is controlled by solenoid valves 34, 44 actuated by the operator of the machine using air switch actuation through line $A_W$ and $A_C$. The water pump pressurizes the water/chemical flow to a desired level regulated by a safety valve set at 500 psi for example. If desired, water and chemical flow may be routed around the water pump by a by-pass valve 38 through the water by-pass line $W_1$ into the safety valve 40, and via line $W_3$ into the sheath interior passage 22.

The drive motor is connected to the brush drive shaft by a suitable mechanical connection such as a drive belt and pulley arrangement indicated by dash line 46. An AC inverter motor controller with potentiometer 30*a* that controls resistance to speed control circuit board provides for varying the motor speed from between 200 rpm to 800 rpm. In this way rotary speed of the brush may be regulated to minimize slip of the brush with respect helix grooves in enhanced tubes and to select an appropriate brush speed for smooth bore tubes in relation to the natural feed rate of the brush and the speed with which the sheath and brush assembly is driven linearly through tubes in cleaning operations.

The drive motor is controlled by air switch actuation through air line $A_M$.

In operation, the operator selects whether chemical are to be used by actuating a toggle switch which controls the chemical solenoid valve. Motor operation is regulated by a foot treadle air switch arrangement for forward and reverse operation of the drive motor. The water and chemical solenoids are connected to the air switches. Actuation of the motor forward speed foot treadle air switch opens the water solenoid and the chemical solenoid when enabled by its toggle switch so that both water and chemical are fed into the sheath passage for application to a tube surface by the rotating brush. When the forward air switch is released, the chemical solenoid closes. The water solenoid also closes. On actuation of the motor reverse air switch, the water solenoid only is open. When the reverse switch is deactivated, both the water and chemical solenoids are deactivated.

The motor runs constantly when power is on and forward and reverse operation are controlled by the foot treadle.

The tube cleaning machine provides for variable brush speed, high water pressure and rate of flow with simultaneous chemical and mechanical cleaning. The rate of water flow through the pump is preferably at least 2.2 gallons per minute. For enhanced tube applications, a brush speed of 200 rpm is selected. For smooth bore tubes a brush speed of 800 prm is selected. In each case brush speed can be altered to achieve optimum cleaning results.

Various changes may be made to the support elements embodying the principles of the invention. The foregoing embodiments are set forth in an illustrative and not in a limiting sense.

I claim:

1. A tube cleaning machine for smooth bore tubes and enhanced tubes comprising a speed adjustable, reversible drive motor, a tube cleaning brush, a flexible drive shaft being driven in rotation at one end by said motor and having the brush affixed at its other end, a sheath encasing the drive shaft and defining an interior passage for flow of cleaning medium of water and chemical components from the machine to the brush, the machine having a water side including a water solenoid valve and a water pump for delivering to said sheath, the machine further having a chemical side including a chemical solenoid valve and a chemical injector for adding cleaning chemical to the water side, an actuation system for operating the drive motor in forward and reverse rotation, the water side, and the chemical side to provide cleaning medium to the sheath interior passage, the actuation system being effective to operate the water solenoid valve and the chemical solenoid valve on forward rotation of the drive motor, and the water solenoid valve on reverse rotation of the drive motor so that in forward drive both water and chemical flow to the cleaning brush and in reverse rotation only water flows to the cleaning brush, and means for adjusting drive motor speed to select optimum brush rotation for smooth bore and enhanced tubes.

2. A tube cleaning machine as defined in claim 1 which further includes means for inactivating the chemical solenoid valve so that water only flows to the cleaning brush during operation of the machine.

3. A tube cleaning machine for smooth bore tubes and enhanced tubes comprising a speed adjustable, reversible drive motor, a tube cleaning brush, a flexible drive shaft being driven in rotation at one end by said motor and having the brush affixed at its other end, a sheath encasing the drive shaft and defining an interior passage for flow of cleaning medium of water and chemical components from the machine to the brush, the machine having a water side including a water solenoid valve and a water pump for delivering to said sheath, the machine further having a chemical side including a chemical solenoid valve and a chemical injector for adding cleaning chemical to the water side, an actuation system for operating the drive motor in forward and reverse rotations, the actuation system for further providing both water and chemical components to the sheath interior passage on forward rotation of the drive motor and water only to the sheath interior passage on reverse rotation of the drive motor, and means for adjusting drive motor speed to select optimum brush rotation for smooth bore and enhanced tubes.

4. A tube cleaning machine as defined in claim 3 which further includes means for inactivating the chemical solenoid valve so that water only flows to the cleaning brush during operation of the machine.

5. A tube cleaning machine for smooth bore tubes and enhanced tubes comprising a reversible drive motor, a tube cleaning brush, a flexible drive shaft being driven in rotation at one end by said motor and having the brush affixed at its other end, a sheath encasing the drive shaft and defining an interior passage for flow of cleaning medium of water and chemical components from the machine to the brush, the machine having a water side including a water solenoid valve and a water pump for delivering to said sheath, the machine further having a chemical side including a chemical solenoid valve and a chemical injector for adding cleaning chemical to the water side, and an actuation system for operating the drive motor in forward and reverse rotation, the water side, and the chemical side to provide cleaning medium to the sheath interior passage, the actuation system having an air switch pedal for actuating both forward rotation of the drive motor and also the water solenoid valve and the chemical solenoid valve through the intermediation of air activated electric contact switches, the air switch pedal for further actuating both reverse rotation of the drive motor and also the water solenoid valve through one of said contact switches, so that in forward drive both water and chemical flow to the cleaning brush and in reverse rotation only water flows to the cleaning brush.

6. A tube cleaning machine as defined in claim 5 which further includes means for inactivating the chemical solenoid valve so that water only flows to the cleaning brush during operation of the machine.

* * * * *